US005106080A

United States Patent [19]

Jones

[11] Patent Number: 5,106,080

[45] Date of Patent: Apr. 21, 1992

[54] LEG PRESS EXERCISE MACHINE

[75] Inventor: Gary A. Jones, Falmouth, Ky.

[73] Assignee: Hammer Corporation, Cincinnati, Ohio

[21] Appl. No.: 568,506

[22] Filed: Aug. 16, 1990

[51] Int. Cl.[5] ..... A63B 21/06

[52] U.S. Cl. ..... 482/97; 482/137

[58] Field of Search ..... 272/96, 117, 118, 123, 272/134; 128/25 B

[56] References Cited

U.S. PATENT DOCUMENTS

| | | | |
|---|---|---|---|
| 3,573,865 | 4/1971 | Annas | 272/117 |
| 3,858,873 | 1/1975 | Jones . | |
| 3,998,454 | 12/1976 | Jones . | |
| 4,149,714 | 4/1979 | Lambert, Jr. | 272/118 |
| 4,511,137 | 4/1985 | Jones | 272/134 X |
| 4,600,188 | 7/1986 | Bangerter et al. | 272/96 |
| 4,678,187 | 7/1987 | Prsala | 272/134 X |
| 4,684,126 | 8/1987 | Daleboot et al. | 272/134 |
| 4,720,099 | 1/1988 | Carlson . | |
| 4,807,871 | 2/1989 | Bryson | 272/134 X |
| 4,813,666 | 3/1989 | Costilow et al. | 272/117 X |
| 4,915,378 | 4/1990 | Abrahamian et al. | 272/134 |

OTHER PUBLICATIONS

Brochure "Leverage Machines" by Nautilus®, Instruction Manual, p. 5.

*Primary Examiner*—Robert Bahr

*Attorney, Agent, or Firm*—Wood, Herron & Evans

[57] ABSTRACT

A leg press exercise machine includes a frame, a declined seat supported by the frame and a pair of levers with upper ends pivotally connected to the frame forward and above the seat. Hubs located at the forward, lower ends of the levers are adapted to hold removable weights to provide a predetermined resistance for an exerciser supported on the seat performing a leg press exercise. The exerciser exerts force from the bottoms of the feet against angled foot pads that are rigidly mounted to the levers, thereby hingedly raising the levers upward and forward. By providing two independently pivotal, weight supporting levers, an exerciser may exercise both legs independently, either in simultaneous motion or alternate motion.

10 Claims, 4 Drawing Sheets

LEG PRESS EXERCISE MACHINE

FIELD OF THE INVENTION

This invention relates to a leg press exercise machine that effectively couples maximum muscular benefit with minimal joint stress for a leg press exercise.

BACKGROUND OF THE INVENTION

Many athletes and non-athletes utilize weight lifting or weight training exercises to build strength and/or bulk, to prevent injury, or to improve overall condition and appearance. Traditionally, weight training exercises were performed with free weights, i.e., barbells, weighted plates and dumbbells, etc. However, over the past 20 years or so, a number of exercise machines have also been developed. While on the one hand many individuals involved in weight training believe that maximum bulk and strength can be achieved only with free weights, it is also generally recognized that exercise machines are safer than free weights. For various reasons, most exercise programs incorporate both machines and free weights in a variety of different exercise routines to maximize the effect of working out the desired number of muscle groups.

One exercise maneuver considered to be particularly important for power lifters, football players, shot put and discuss throwers is referred to as a leg press. A leg press involves straightening of the legs from a bent position against a weight resistance, the exerciser being either seated in a declined position and pushing horizontally against the weight resistance, or lying on the back and pushing upwardly against the weight resistance. The leg press is particularly effective in building up the semi-tendonosis, semi-membrosis and biceps femorosis muscles, commonly referred to as the hamstrings. Perhaps more importantly, exercising the muscles associated with the leg press motion is extremely important because it develops "thrusting" capability that is extremely important to success in the sports mentioned above, or other "power" sports.

At one time, a leg press was performed by balancing a weighted barbell on the bottoms of the feet of an athlete lying on his back. The athlete simply pushed upwardly to raise the barbell while at the same time, keeping it balanced on the feet. For obvious safety reasons, most weight lifters now perform a leg press exercise with a leg press exercise machine.

While there have been a number of prior leg press exercise machines, it is applicant's opinion that there is room for improvement in these leg press exercise machines. This opinion is grounded upon the recognition that the leg press exercise develops some of the strongest and largest muscles of the human body. For some rather large individuals, it may involve a weight of up to 1,000 pounds, or more. Yet, because this exercise begins with the legs in a retracted position, initial stress upon the ankles, hips and particularly the knees is substantial.

While a certain amount of compressive force and/or shear stress on joints associated with the leg press muscle group is simply unavoidable, it has been applicant's opinion that this joint stress can be and should be reduced, particularly at the initial stage of the leg press exercise.

It is therefore an object of this invention to provide an improved leg press exercise machine that maximizes muscular benefit achieved during performance of a leg press exercise, but with minimized stress upon joints associated with the muscle group that performs the leg press movement.

SUMMARY OF THE INVENTION

To these ends, this invention contemplates a leg press exercise machine that employs two, independently pivotal levers connected to a frame forward and above a declined seat supported by the frame. The angle of the declined seat and the initial starting angles of the levers and the foot pads against which the leg press force is directed are oriented such that, in combination, based upon feedback from a number of individuals involved in weight training, this machine seems to "fit" the body more naturally than prior machines and provides maximum muscular benefit with minimum joint stress.

According to a preferred embodiment of the invention, this leg press exercise machine includes a reinforced frame, a declined seat supported by the frame and two independently pivotal levers connected to the frame forward and above the seat. The seat is slidably adjustable along a declined support member to better accommodate different sized individuals, or different leg lengths. The seat also includes a bottom support and a back support, the width of the bottom support being narrower than the width of the back support to better accommodate forward extension of the legs. The sides of the frame diverge rearwardly to facilitate access to the seat for an exerciser.

Compared to a prior, single lever leg press exercise machine for use by both legs, an exerciser using this machine is seated in more of a "straight up" position and the initial starting angles of the levers are closer to vertical. As a result, the initial force required to pivot the levers upwardly is reduced. Applicant has found that these changes more closely reflect the natural strength curve of the muscle group utilized in performing the leg press maneuver. Basically, a strength curve represents the ability of a particular muscle group to resist an applied force through the course of a particular movement. A strength curve may be ascending, descending or even sinusoidal. For a leg press exercise machine utilizing a lever, the applied force depends upon the moment arm of the lever about the pivot axis. As the legs are extended, the moment arm increases with the sine of the angle of the lever.

For any given exercise, the degree of difficulty experienced by an exerciser will be relatively continuous, i.e., without "sticking" points, if the applied force substantially matches the strength curve. For the leg press, evidence indicates that the strength curve for this particular muscle group is initially quite low, increases gradually and then increases sharply. This leg press machine attempts to accommodate a strength curve of this type by reducing the initial applied force. This is accomplished by reducing the initial angle (from vertical), or the starting position, of the lever to about 20° from vertical.

Because two separate, independently maneuverable pivotal levers are provided, a more intense muscular workout is achieved with this leg press exercise machine than would otherwise be provided with one, double-leg lever. With two levers, an exerciser is required to develop independent control of the muscles of each leg and is able to readily compare relative strengths of both legs. Moreover, this feature is particularly useful for rehabilitation, where it is often useful to isolate and compare the relative strength of the legs in order to measure progress.

These and other features of the invention will be more readily understood in view of the following detailed description and the drawings.

DETAILED DESCRIPTION OF THE DRAWINGS

Figure 1:
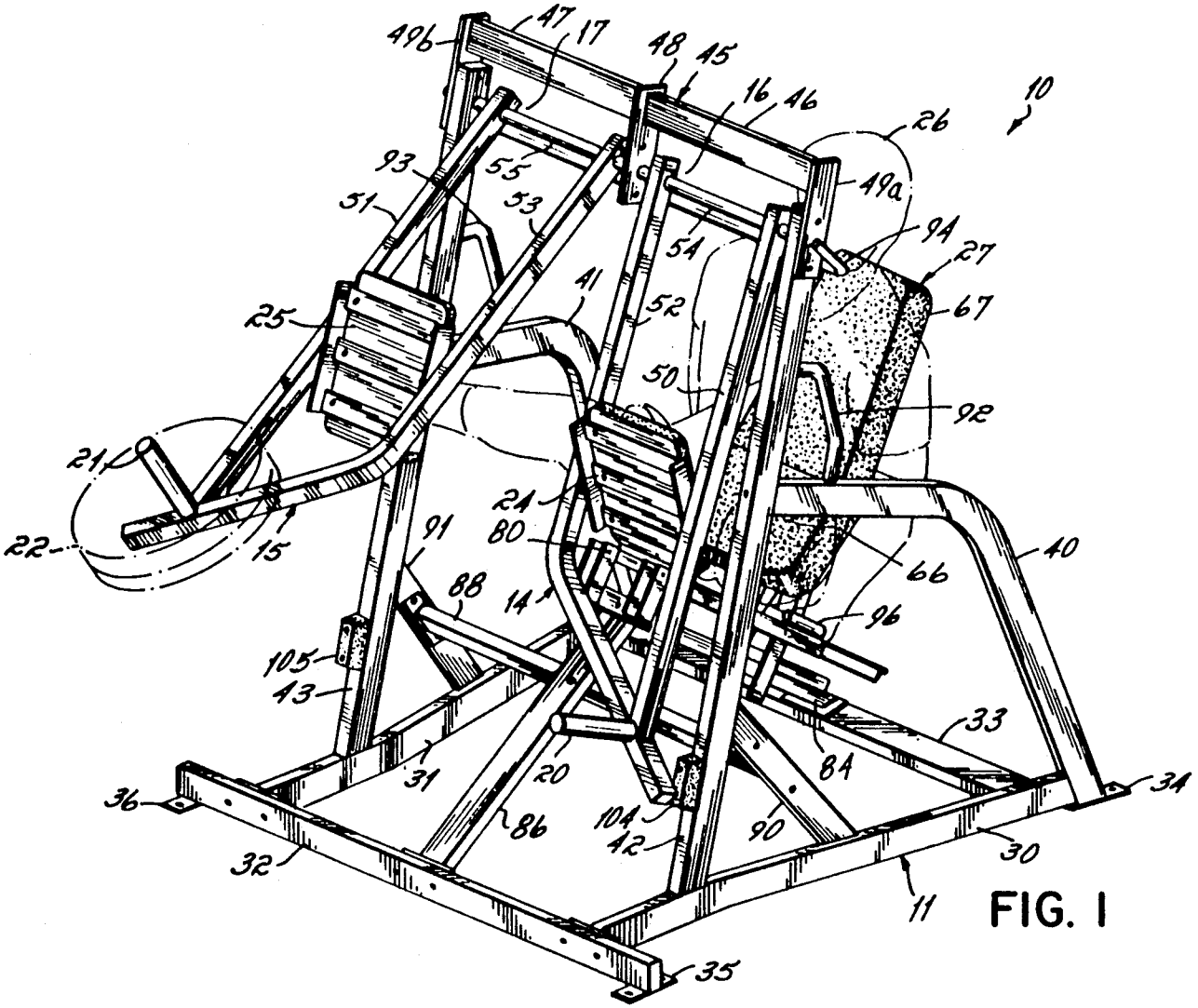
FIG. 1 is a perspective view of a leg press exercise machine in accordance with a preferred embodiment of the invention.

FIGS. 1–4 show a leg press exercise machine 10 in accordance with a preferred embodiment of the invention. This machine 10 includes a frame 11 made of a number of straight and/or curved sections of heavy duty steel that are either welded or bolted together, or pivotally connected. Leg press levers 14 and 15 are pivotally connected to the frame 11. The levers 14 and 15 have upper ends 16 and 17, respectively, that pivot about a pivot axis 18. Lower ends of levers 14 and 15 include hubs 20 and 21, respectively, which are adapted to support one or more removable weights 22 to provide a desired weight resistance during the leg press exercise. The locations and angles of the hubs facilitate placement and removal of heavy weighted plates. The levers 14 and 15 also include centrally located, angled foot pad sections 24 and 25, respectively, which are contacted by the bottoms of the feet of an exerciser 26 supported on a declined seat 27 during performance of a leg press exercise.

The frame includes bottom side supports 30 and 31, and bottom front and back supports 32 and 33. These support pieces are either welded together or provided with metal end sections that are bolted at the connection points. The bottom supports are preferably welded at the corners of the frame 11 to flat metal pieces 34, 35, 36 and 37 (FIG. 2) so that the frame 11 can be more easily bolted to either a base or a transport mechanism.

The frame 11 also includes, on each side, an upwardly extending back leg and front leg. As shown in FIG. 1, the left side of the frame (from the perspective of the exerciser 26 supported on the seat 27) includes back leg 40 and front leg 42. The right side of the frame includes back leg 41 and front leg 43. The back legs 40 and 41 have rearward ends connected to the rear ends of bottom supports 30 and 31, respectively, and they extend forwardly and upwardly toward the front legs 42 and 43, with a centrally located bend. Front legs 42 and 43 are connected at their top ends to an upper horizontal brace 45 which includes a left section 46, a right section 47, a central downwardly extending plate 48, and outer downwardly extending plates **49*a* and 49*b*. The brace 45 is located above pivot axis 18**.

Each lever 14 and 15 includes an outer, straight section, an inner, bent section and an upper axle, all of which are rigidly connected together. Lever 14 includes outer section 50, inner bent section 52 and axle 54. Lever 15 includes outer section 51, inner section 53 and axle 55. The intermediately located, foot pads or foot sections 24 and 25 are rigidly secured to levers 14 and 15, respectively, between their respective inner and outer sections 50 and 51. The ends of the axles 54 and 55 are connected to the downwardly projecting plates **49*a* and 48, and 49*b* and 48**, respectively, by bearings (not shown). A pillow block bearing sold by Browning, Part No. VF 2S 116 has proved suitable, particularly because maintenance of these bearings consists essentially of one shot of lubricating oil per year.

Figure 2:
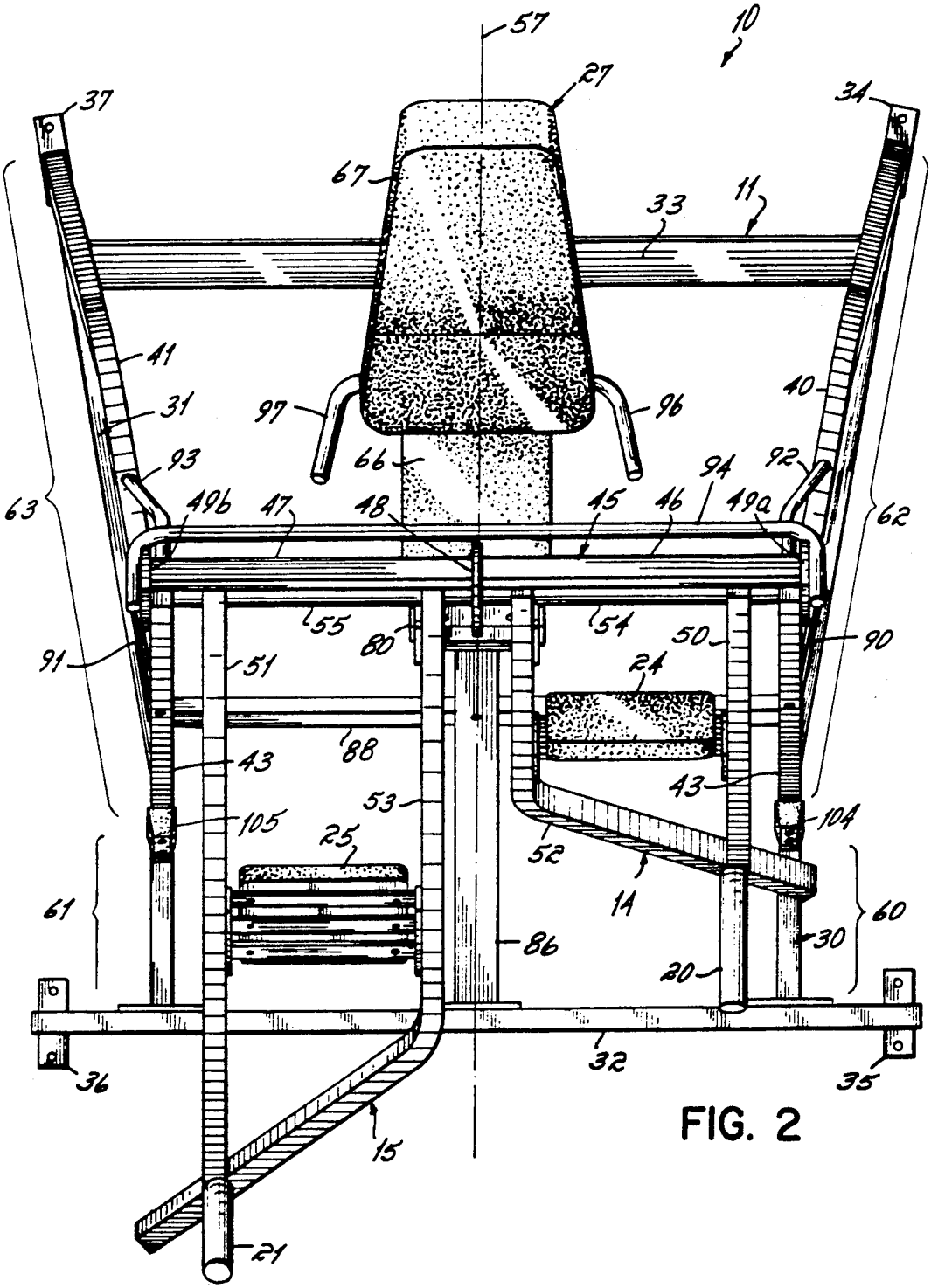
FIG. 2 is a top view of the leg press exercise machine shown in FIG. 1.

As shown more clearly in FIG. 2, the frame 11 is symmetric with respect to a central vertical plane 57 that extends through the center of the machine 10. FIG. 2 also shows that bottom side legs 30 and 31 include forward parallel portions 60 and 61 to which the bottom ends of legs 42 and 43, respectively, are connected. Behind the connection points of legs 42 and 43, the side supports 30 and 31, respectively, bend outwardly or diverge with respect to the rear of the frame 11. These rearwardly diverging sections are designated by numerals 62 and 63. This rearward divergence of side supports 30 and 31 facilitates access to the seat 27 by an exerciser 26.

Figure 3:
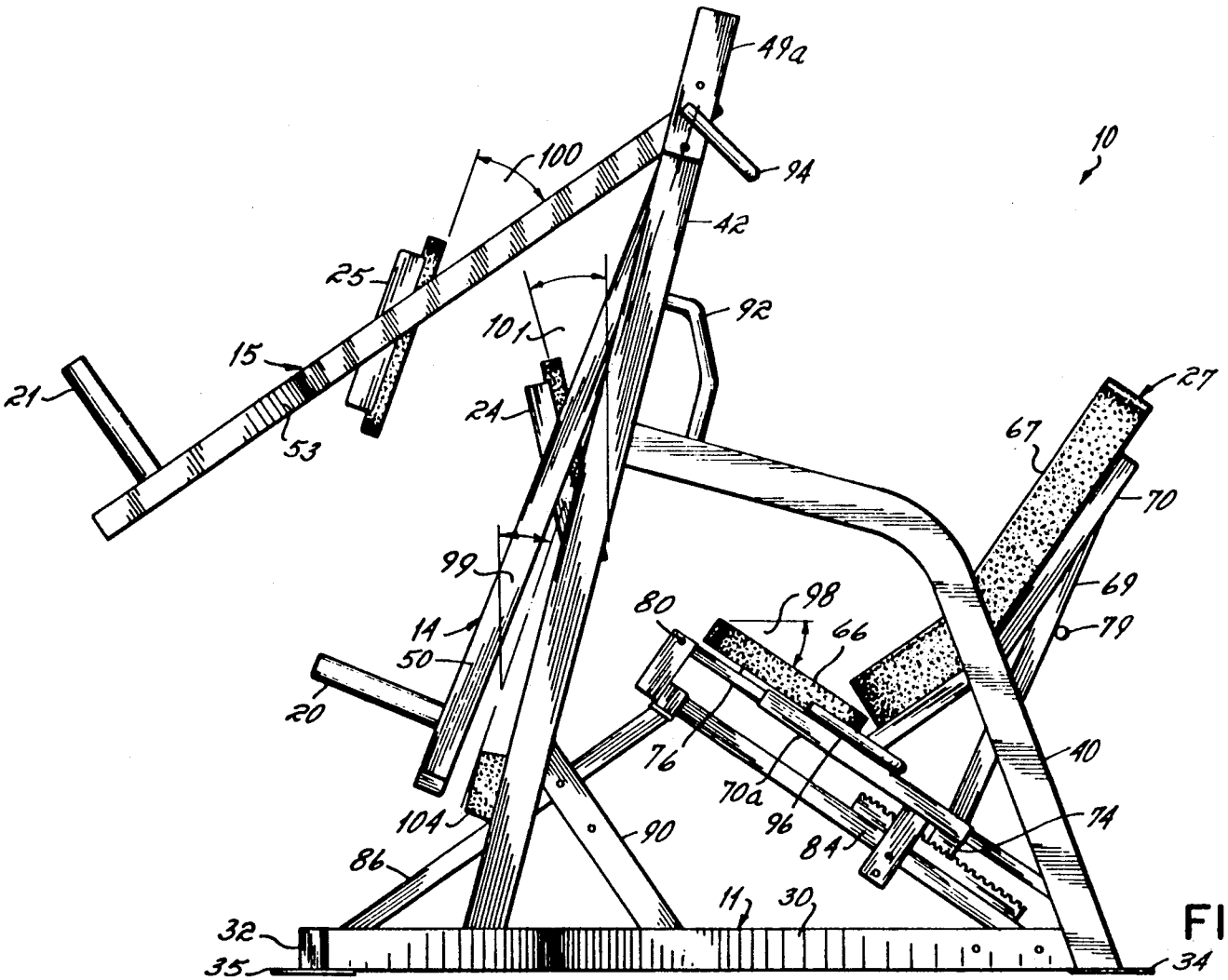
FIG. 3 is a side view of the leg press exercise machine shown in FIG. 1.
Figure 4:
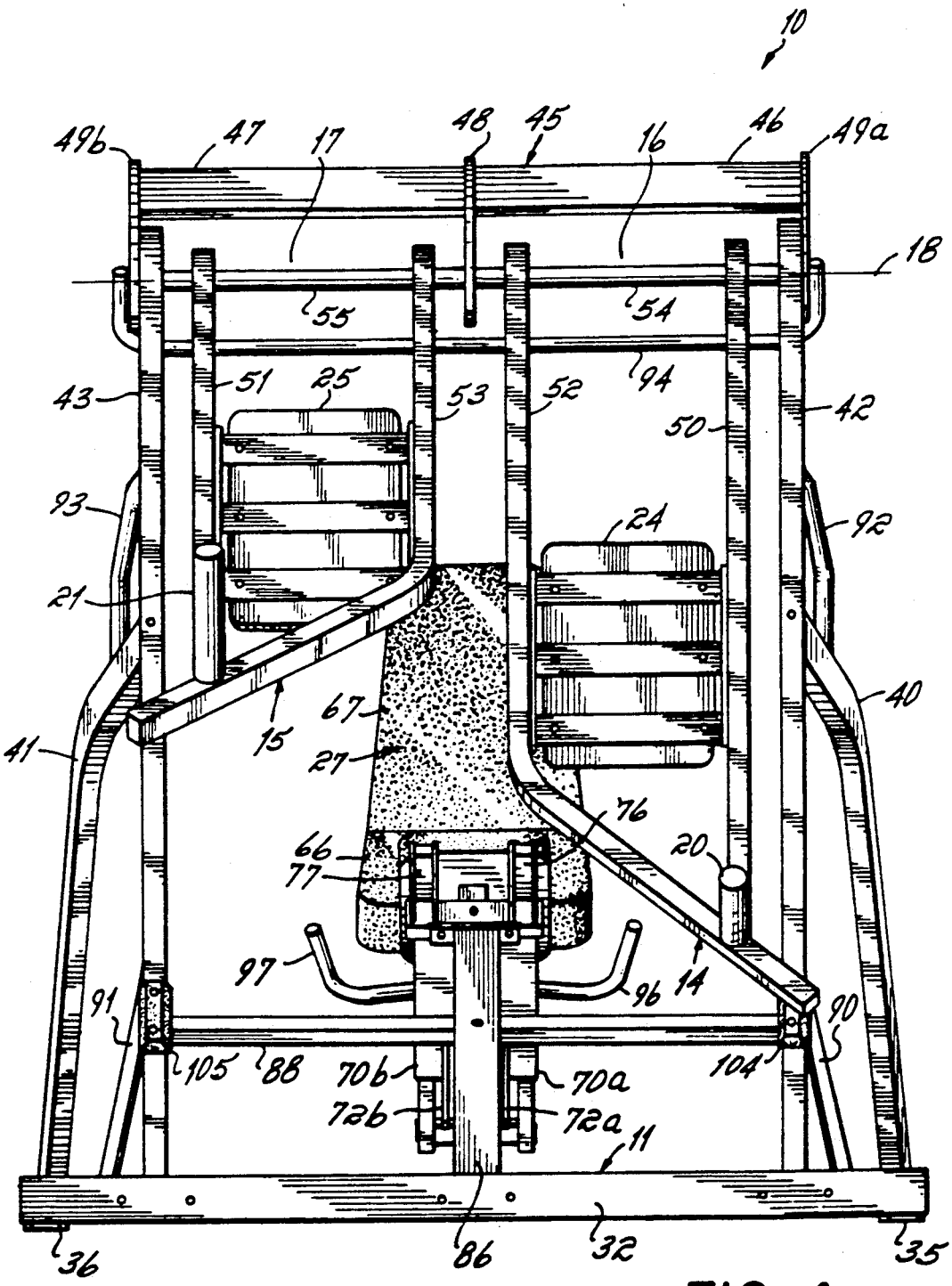
FIG. 4 is a front view of the leg press exercise machine shown in FIG. 1.

As shown most clearly in FIG. 3, seat 27 includes a bottom support 66 and a back support 67. The back support 67 has upper and lower sections which are angled with respect to each other. As shown most clearly in FIG. 2, bottom support 66 has a narrower width than back support 67, to facilitate forward extension of the legs in the direction of the foot pads 24 and 25.

Seat 27 also includes back braces 69 and 70 which support the back support 67 (FIG. 3), and a pair of guide channels **70*a* and 70*b* (FIG. 4) which support the bottom support 66. All of those parts, along with a pair of downwardly projecting sections 72*a* and 72*b* (FIG. 4) and a toothed section 74 slide along a pair of stationary, parallel guide rails 76 and 77. To slidably adjust the seat 27, a rod-shaped handle 79 welded horizontally to back brace 69 is lifted upwardly to pivot the seat 27 about forward pivot point 80. Once pivotally raised, the seat 27 is slidably adjustable along parallel guide rails 76 and 77. When lowered, the downwardly directed teeth of section 74 mesh with the upwardly directed teeth of member 78, which is located on top of and rigidly connected to declined section 84. All of these declined parts and sections are supported forwardly by a front brace 86**.

For additional structural support, legs 42 and 43 are reinforced near their bottoms by members 90 and 91, respectively. A horizontally extending brace 88 is connected from member 90 to member 91, and it is also bolted or otherwise connected to front brace 86. The legs 42 and 43 are also reinforced adjacent legs 40 and 41 by members 92 and 93, respectively. An additional, horizontal handle 94 may be provided across the tops of the machine 10. Also, the seat 27 preferably includes a pair of handles, designated by numerals 96 and 97.

Preferably, the declined angle of seat 27 is about 30° with respect to horizontal, designated by numeral 98. The initial, at rest, angle of the levers with respect to vertical is about 20°, designated by numeral 99. The angle of connection of the foot pads with respect to the levers is about 35, designated by numeral 100. This places the fronts of the foot pads at an initial, at rest, angle of about 15° with respect to vertical. This angle is designated in FIG. 3 by numeral 101. Numeral 101 shows the angle of the foot pad 24 after lever 14 has been rotated further downwardly into contact with a bumper 104.

Compared to the prior lever leg press exercise machine, this machine 10, the initial angle of the levers is closer to vertical, the seat 27 is rotated slightly forward to place the exerciser 26 in more of a "straight up" position, and the angle of the foot pads with respect to the lever is less. As a result of these changes, and due to the use of two independently movable levers, this machine 10 provides maximum muscular isolation of the desired leg press muscle group, i.e., the semi-tendonosis, semi-membrosis and biceps femorosis (commonly referred to as the "hamstring") thus assuring that a maximum workout benefit is achieved. Moreover, this maximum muscular benefit is provided with minimum compressive and/or shear stress on the joints associated with this muscle group.

While a preferred embodiment of the invention has been described, it is to be understood that the invention is not limited thereby and that in light of the present disclosure, various other alternative embodiments will be apparent to a person skilled in the art. Accordingly, it is to be understood that changes may be made without departing from the scope of the invention as particularly set forth and claimed.

I claim:

1. A leg press exercise machine comprising:

a frame;

a declined seat supported by the frame; and a pair of levers having upper ends pivotally connected to the frame above and forward of the seat, each lever having a lower end adapted to hold at least one removable weight and an angled foot section adapted to be contacted by the bottom of the foot and pressed forwardly and upwardly by an exerciser supported on the seat during performance of a leg press exercise; and a pair of hubs, each hub located at a lower forward end of a lever and adapted to hold at least one removable weight.

2. The leg press exercise machine of claim 1 wherein the levers have an initial at rest angle of about 20° from vertical.

3. The leg press exercise machine of claim 2 wherein each foot section is angled with respect to its respective levers at an angle of about 35°.

4. The leg press exercise machine of claim 1 wherein the frame includes two sides that are symmetric with respect to a central vertical plane and the sides diverge rearwardly with respect to the seat to facilitate access to the seat.

5. The leg press exercise machine of claim 1 wherein the seat is declined from horizontal at an angle of about 20°.

6. The leg press exercise machine of claim 1 and further comprising:

a fixed, rearwardly declined member for supporting the declined seat; and means for slidably adjusting the seat along the rearwardly declined member.

7. The leg press exercise machine of claim 1 wherein the back support includes two angled sections.

8. The leg press exercise machine of claim 1 wherein the bottom support has a narrower width than the back support.

9. The leg press exercise machine of claim 2 and further comprising:

a pair of foot pads, each foot pad secured at an angle to a lever, the angle of the foot pad being about 15° from vertical when the lever is in an at rest position.

10. A leg press exercise machine comprising:

a frame;

a declined seat supported on the frame;

a pair of levers, each lever having an upper end pivotally connected to the frame above and forward of the seat;

a pair of hubs, each hub located at a lower end of a lever and adapted to hold at least one removable weight;

a pair of foot pads, each foot pad connected at an angle to a lever and adapted to be contacted and driven hingedly upwardly by the bottom of a foot of an exerciser supported on the seat during performance of a leg press exercise; and a pair of parallel, upwardly and angularly extending frame members, each member coacting with a lever so that the upwardly inclined angle of each member defines an initial, at rest, angle for the respective lever, the initial at rest angle of the lever being about 20° from vertical.

* * * * *